US009044803B1

(12) United States Patent
Propst

(10) Patent No.: US 9,044,803 B1
(45) Date of Patent: Jun. 2, 2015

(54) FLARING TOOL

(76) Inventor: Jeffrey A. Propst, Diamond, OH (US)

( * ) Notice: Subject to any disclaimer, the term of this patent is extended or adjusted under 35 U.S.C. 154(b) by 465 days.

(21) Appl. No.: 13/412,605

(22) Filed: Mar. 5, 2012

(51) Int. Cl.
*B21D 39/08* (2006.01)
*B21D 41/02* (2006.01)

(52) U.S. Cl.
CPC ..... *B21D 41/021* (2013.01); *B21D 41/02* (2013.01); *B21D 39/08* (2013.01)

(58) Field of Classification Search
CPC ..... B21D 39/08; B21D 39/20; B21D 41/02–41/028
USPC ..... 72/298, 301, 302, 305, 306, 308, 309, 72/311, 312, 316, 317, 370.01, 370.06; 279/48, 49, 56, 46.4
See application file for complete search history.

(56) References Cited

U.S. PATENT DOCUMENTS

| | | | | |
|---|---|---|---|---|
| 3,758,932 | A | 9/1973 | Burtis | |
| 4,211,103 | A * | 7/1980 | Grimaldo | 72/316 |
| 4,471,643 | A * | 9/1984 | Champoux et al. | 72/370.07 |
| 4,890,472 | A * | 1/1990 | Rothenberger | 72/393 |
| 5,382,151 | A | 1/1995 | Hayes, Jr. et al. | |
| 5,718,459 | A | 2/1998 | Davie et al. | |
| 6,260,401 | B1 * | 7/2001 | Tada | 72/318 |
| 6,350,087 | B1 * | 2/2002 | Berry et al. | 279/52 |
| 6,619,099 | B2 | 9/2003 | Barjesteh | |
| 6,932,357 | B2 * | 8/2005 | Jacobs et al. | 279/42 |
| 6,935,153 | B2 | 8/2005 | Frigo et al. | |
| 7,152,453 | B2 | 12/2006 | Johnson et al. | |
| D567,267 | S | 4/2008 | Minor | |
| 7,946,147 | B2 * | 5/2011 | Shimai et al. | 72/370.06 |
| 2001/0028170 | A1 | 10/2001 | Sausner et al. | |
| 2005/0271764 | A1 | 12/2005 | McKenzie et al. | |
| 2009/0322042 | A1 * | 12/2009 | Kitamura | 279/49 |

* cited by examiner

*Primary Examiner* — Shelley Self
*Assistant Examiner* — Pradeep C Battula

(57) ABSTRACT

A flaring tool includes a tubular first holding member. A collet well extends into the first holding member. A collet has a primary end positioned in the collet well. A second holding member is coupled to the first holding member. A collet channel extends into the second holding member. The collet well aligns with the collet channel when the second holding member is coupled to the first holding member. The collet has a secondary end that is positioned in the collet channel. A punch channel extends into the second holding member. The punch channel is aligned with the collet. A punch is insertable into the punch channel. The first holding member and the collet receive the line through the first holding member and the collet. The punch compresses the end of the line between the punch and the collet so the end of the line is flared.

1 Claim, 5 Drawing Sheets

FLARING TOOL

BACKGROUND OF THE DISCLOSURE

Field of the Disclosure

The disclosure relates to flaring devices and more particularly pertains to a new flaring device for flaring an end of a metallic brake line.

SUMMARY OF THE DISCLOSURE

An embodiment of the disclosure meets the needs presented above by generally comprising a tubular first holding member. A collet well extends into the first holding member. A collet has a primary end positioned in the collet well. A second holding member is coupled to the first holding member. A collet channel extends into the second holding member. The collet well aligns with the collet channel when the second holding member is coupled to the first holding member. The collet has a secondary end that is positioned in the collet channel. A punch channel extends into the second holding member. The punch channel is aligned with the collet. A punch is insertable into the punch channel. The first holding member and the collet receive the line through the first holding member and the collet. The punch compresses the end of the line between the punch and the collet so the end of the line is flared.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
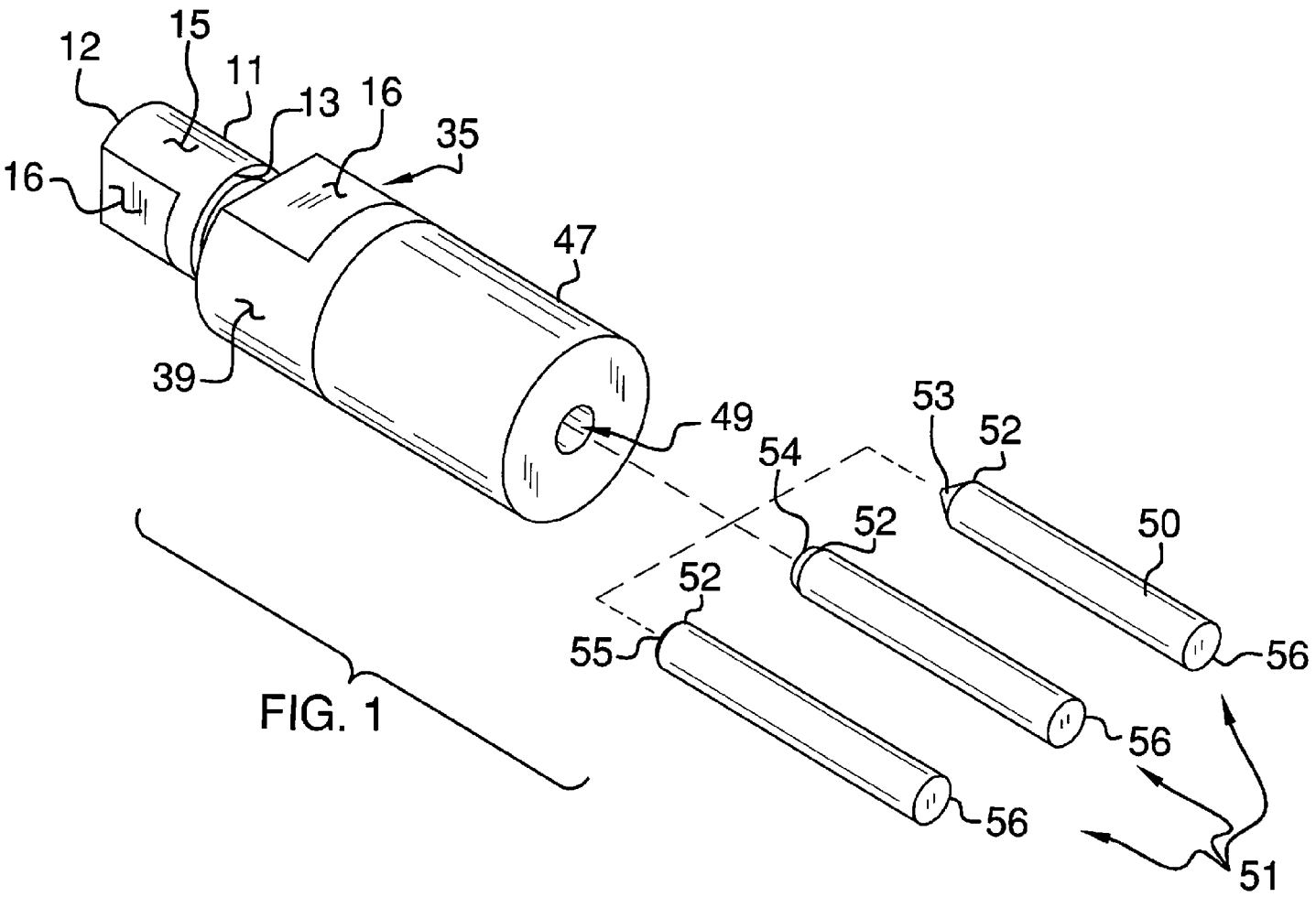
FIG. 1 is a perspective view of a flaring tool according to an embodiment of the disclosure.
Figure 2:
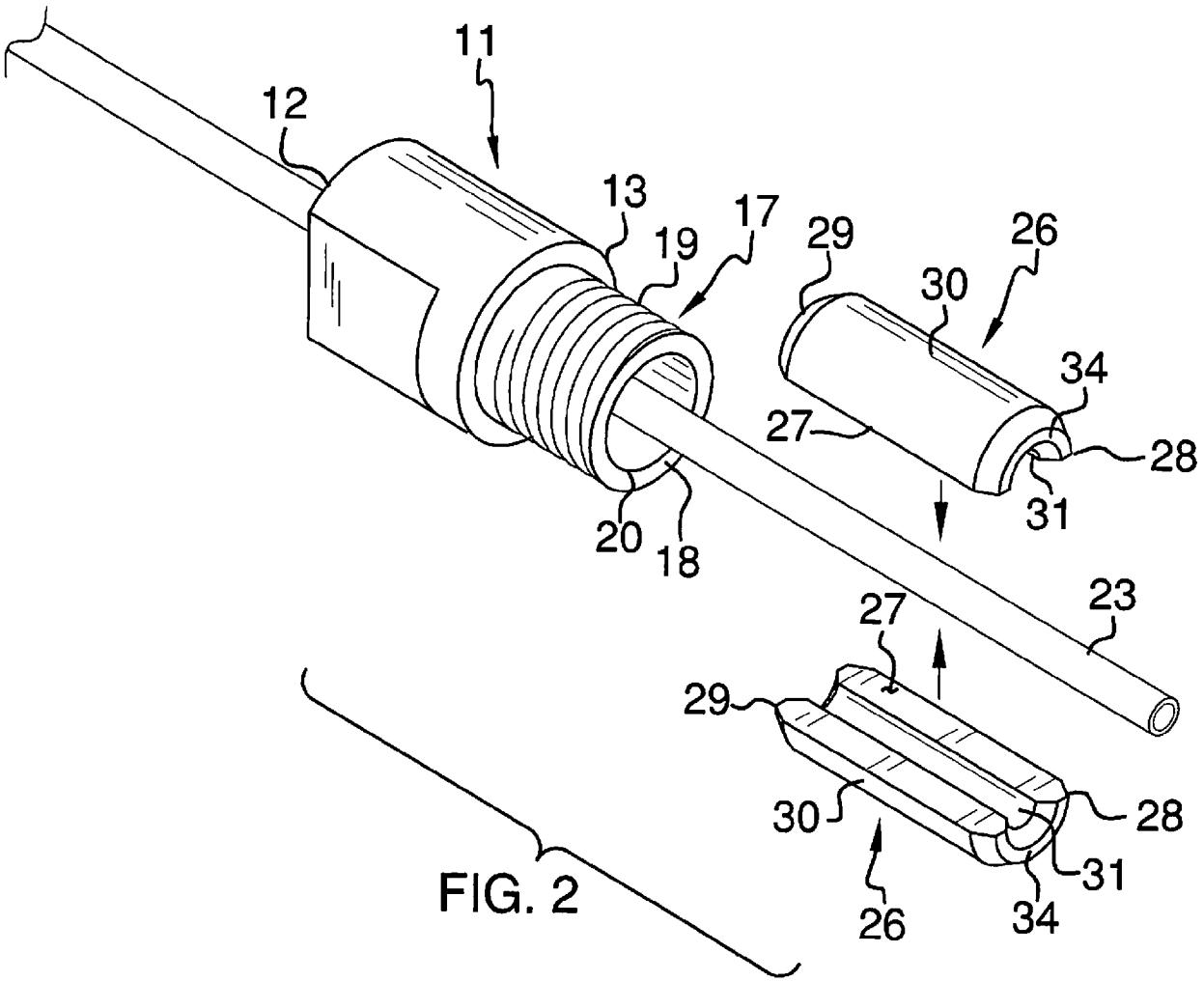
FIG. 2 is a side perspective view of an embodiment of the disclosure.
Figure 3:
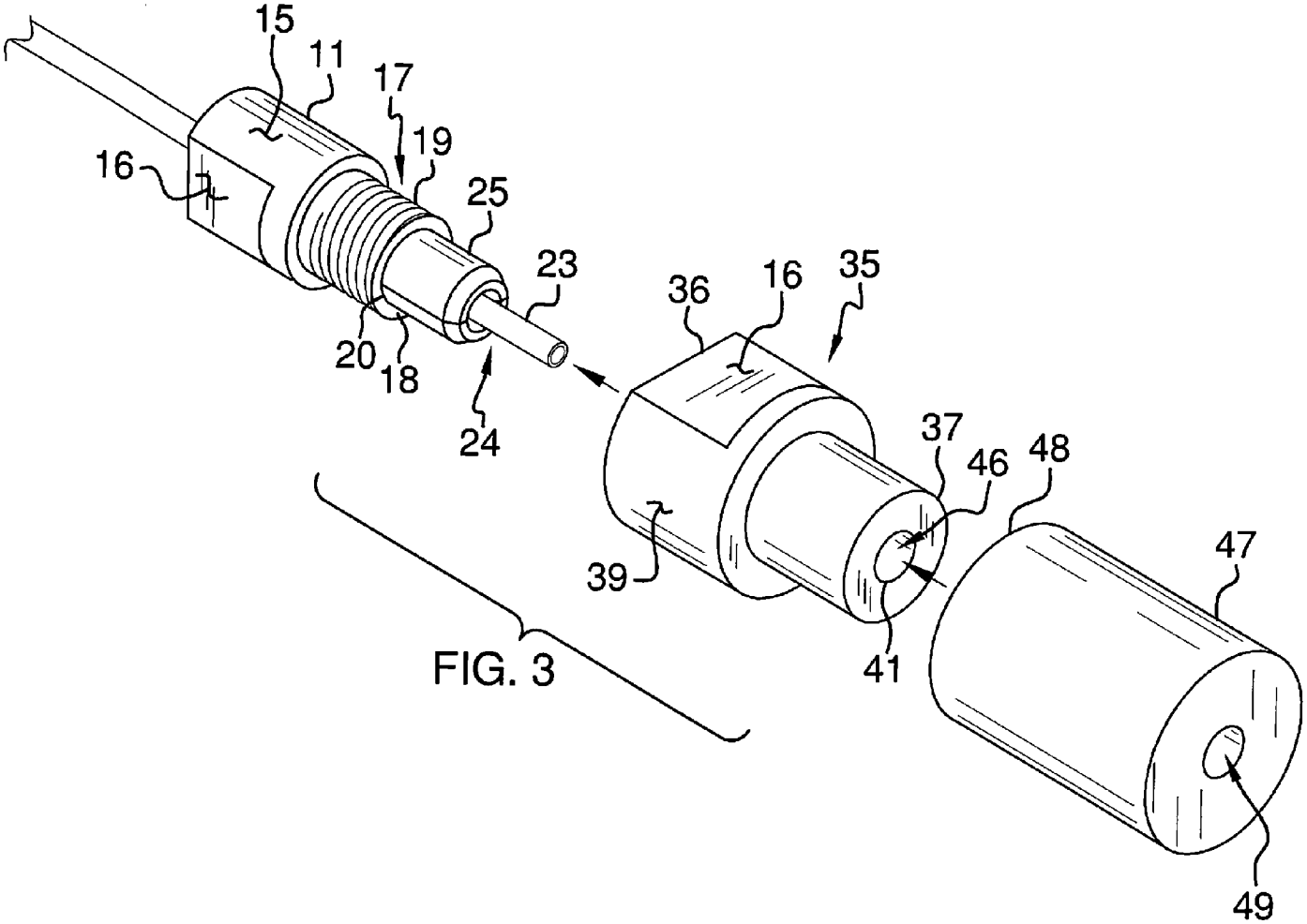
FIG. 3 is an exploded view of an embodiment of the disclosure.
Figure 4:
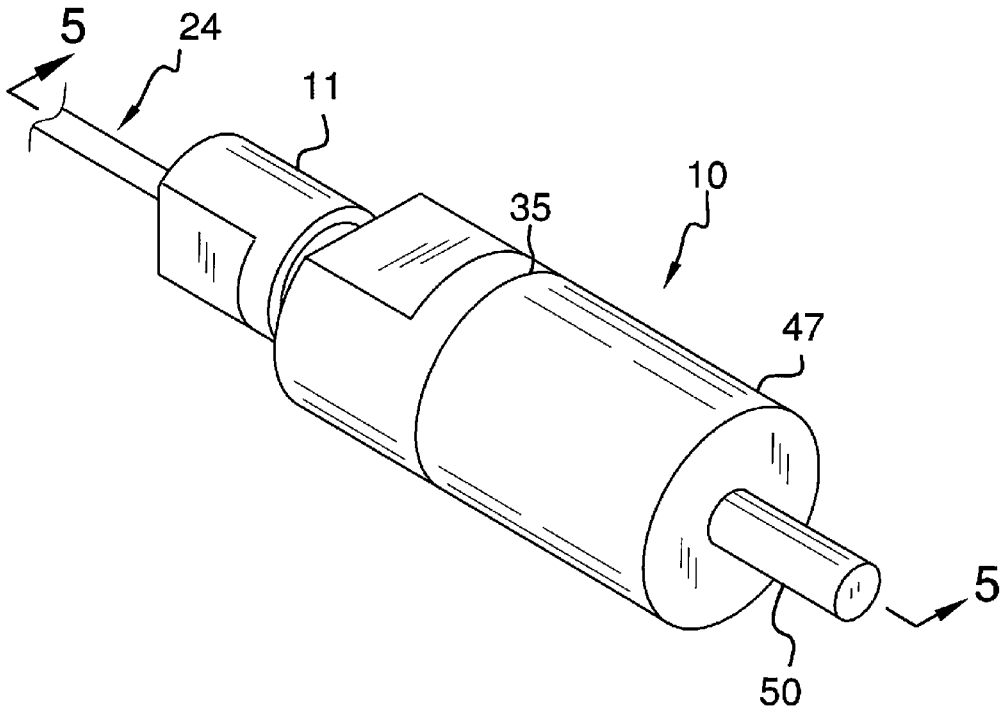
FIG. 4 is an in-use view of an embodiment of the disclosure.
Figure 5:
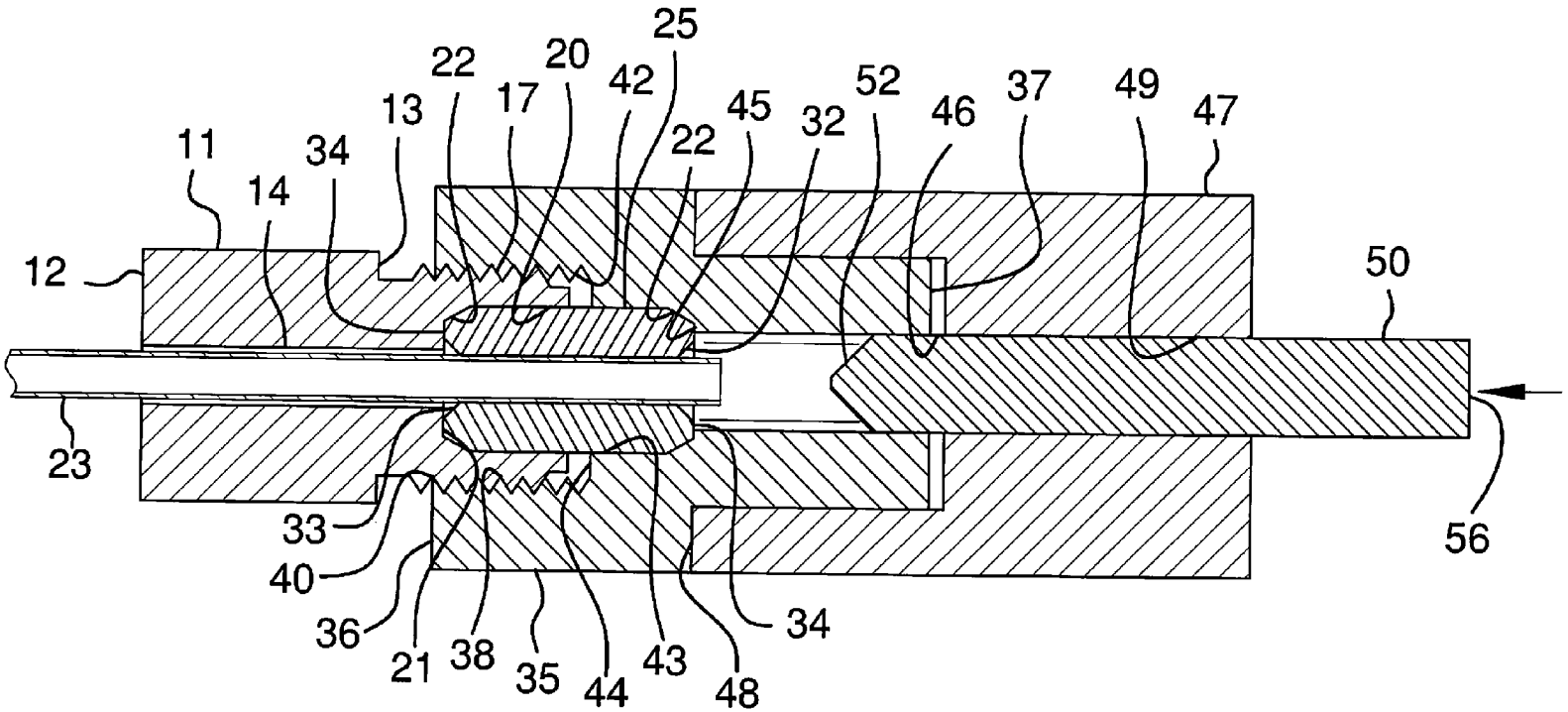
FIG. 5 is across sectional view taken along line 5-5 of FIG. 4 of an embodiment of the disclosure.

With reference now to the drawings, and in particular to FIGS. 1 through 6 thereof, a new flaring device embodying the principles and concepts of an embodiment of the disclosure and generally designated by the reference numeral 10 will be described.

As best illustrated in FIGS. 1 through 6, the flaring tool 10 generally comprises a first holding member 11 that has a cylindrical shape. The first holding member 11 has a first end 12 and a second end 13. The first holding member 11 has a line conduit 14 extending through the first holding member 11 between the first end 12 and the second end 13. An exterior surface 15 of the first holding member 11 has a pair of flat surfaces 16 adjacent to the first end 12 so the first holding member 11 may be gripped by a wrench. The first holding member 11 may be comprised of a rigid material.

A connection portion 17 is coupled to and extends away from the second end 13 of the first holding member 11. The connection portion 17 has a distal edge 18 with respect to the second end 13 of the first holding member 11. An outwardly facing wall 19 of the connection portion 17 is threaded. A collet well 20 is defined by the distal edge 18 and extends through the connection portion 17. The collet well 20 is aligned with the line conduit 14 and a base 21 of the collet well 20 has an angled outside edge 22. The first holding member 11 and the connection portion 17 may have a hydraulic line 23 directed through the line aperture 14 and the collet well 20 so the hydraulic line 23 extends outwardly of the collet well 20. The hydraulic line 23 may be a metallic brake line 24 of a vehicle.

A collet 25 has a pair of separable collet sections 26 that each has a bottom surface 27. The bottom surfaces 27 of each of the collet sections 26 abut to matingly form the collet 25 when the collet 25 is positioned in the collet well 20. The collet 25 has a primary end 28 and a secondary end 29. The collet 25 has a cylindrically curvilinear exterior wall 30 and an interior wall 31 that is co-arcuate with the exterior wall 30. The hydraulic line 23 extends through the collet 25 when the collet 25 is positioned in the collet well 20. The collet 25 may be comprised of a rigid material such as hardened tool steel or other similar material.

The interior wall 21 of the collet 25 is tapered and extends into the collet 25 from the primary end 28 of the collet 25. The interior wall 21 of the collet 25 is tapered and extends into the collet 25 from the secondary end 29 of the collet 25. The interior wall 21 is tapered at a first angle 32 adjacent the primary end 28 of the collet 25 and a second angle 33 adjacent the secondary end 29 of the collet 25. The first angle 32 is less than the second angle 33 relative to a longitudinal axis of the collet 25. An outer edge 34 of each of the first 28 and second 29 ends of the collet 25 is beveled.

A second holding 35 member has a cylindrical shape. The second holding member 35 has an insertion end 36 and a flaring end 37. An inwardly facing wall 38 of the second holding member 35 is threaded. The inwardly facing wall 38 of the second holding member 35 is complimentary to the outwardly facing wall 19 of the connection portion 17. The second holding member 35 is coupled to the first holding member 11 to cause the collet 25 to frictionally engage the hydraulic line 23 to prevent the hydraulic line 23 from slipping in the collet 25. An outer surface 39 of the second holding member 35 has a pair of flat surfaces 16 adjacent to the insertion end 36 so the second holding member 35 may be gripped by a wrench. The flaring end 37 has an outer diameter that is less than an outer diameter of the insertion end 36. The second holding member 35 may be comprised of a rigid material.

An insertion well 40 extends into the insertion end 36. The flaring end 37 has a flaring aperture 41 extending into the flaring end 37. The flaring aperture 41 is aligned with the collet well 20 when the second holding member 35 is coupled to the first holding member 11. The connection portion 17 threadably engages an inner surface 42 of the insertion well 40 so the secondary ends 29 of the collets 25 are directed into the insertion well 40.

A collet channel 43 extends into the second holding member 35. The collet channel 43 extends into a basal wall 44 of the insertion well 40. The collet well 20 is aligned with the collet channel 43 when the second holding member 35 is coupled to the first holding member 11. A foundation 45 of the collet channel 43 has an angled outside edge 22. The secondary end 29 of the collet 25 is positioned in the collet channel 43 so the secondary end 29 abuts the foundation 45 of the collet channel 43. The beveled outer edges 34 of the primary end 28 and the secondary end 29 of the collet 25 are complimentary to the angled outside edges 22 of the collet well 20 and the collet channel 43. The secondary end 29 of the collet 25 is selectively positionable within the collet well 20 and the primary end 28 is selectively positionable within the collet channel 43.

A punch channel 46 extends into the second holding member 35. The punch channel 46 is aligned with the collet 25 when the second holding member 35 is coupled to the first holding member 11. An alignment sleeve 47 has an open end 48 that is slidably insertable on the second holding member 35. The open end 48 insertably receives the flaring end 37. The alignment sleeve 47 has an alignment channel 49 that is positionable to align with the punch channel 46 when the alignment sleeve 47 is coupled to the second holding member 35.

A punch 50 is one of a plurality of punches 51 that each has an impact end 52 selectively insertable into the punch channel 46. The impact end 52 is tapered and extends towards the impact end 52 of the punch 50. Each of impact ends 52 is tapered in one of at least three varying geometries to include a triangular taper 53, a round taper 54 and blunt taper 55. The plurality of punches 51 has a striking end 56 and each of the punches 50 is configured to be struck on the striking end 56 urging the impact end 52 into an end of the hydraulic line 23. The plurality of punches 51 may be comprised of a rigid material such as hardened tool steel or other similar material. The end of the hydraulic line 23 is flared by the impact end 52 of the punch 50.

In use, the hydraulic line 23 may be inserted into the first holding member 11 and retained in position by the collet 25 after the second holding member 35 is coupled to the first holding member 11. A wrench may be used to tighten the first 11 and second 35 holding members together. A selected punch 50 may be driven into the end of the hydraulic line 23 to flare the hydraulic line 23 against the primary end 28 of the collet 25.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A flaring tool configured for flaring an end of a metallic brake line, said assembly comprising;

a first holding member having a cylindrical shape, said first holding member having a first end and a second end, said first holding member having a line conduit extending through said first holding member between said first end and said second end, an exterior surface of said first holding member having a pair of flat surfaces adjacent to said first end whereby said first holding member is configured to be gripped by a wrench;

a connection portion being connected to and extending from said second end of said first holding member, said connection portion having a distal edge with respect to said second end of said first holding member, an outwardly facing wall of said connection portion being threaded;

a collet well extending through said connection portion, said collet well being aligned with said line conduit, a base of said collet well having an angled outside edge, said first holding member and said connection portion being configured to have a hydraulic line directed through said line aperture and said collet well such that the hydraulic line extends outwardly of said collet well;

a collet having a pair of separable collet sections matingly forming said collet when said collet is inserted into said collet well, said collet having a primary end and a secondary end, an interior wall of said collet being tapered extending into said collet from said primary end of said collet, said interior wall of said collet being tapered extending into said collet from said secondary end of said collet, said interior wall being tapered at a first angle adjacent said primary end of said collet and a second angle adjacent said secondary end of said collet, said first angle being less than said second angle relative to a longitudinal axis of said collet, an outer edge of each of said first secondary ends of said collet being beveled;

a second holding member having a cylindrical shape, said second holding member having an insertion end and a flaring end, an inwardly facing wall of said second holding member being threaded, said inwardly facing wall of said second holding member being complimentary to said outwardly facing wall of said first holding member, an outer surface of said second holding member having a pair of flat surfaces adjacent to said insertion end whereby said second holding member is configured to be gripped by a wrench, said flaring end having an outer diameter being less than an outer diameter of said insertion end;

an insertion well extending into said insertion end, said flaring end having a flaring aperture extending into said flaring end, said flaring aperture being aligned with said collet well when said second holding member is coupled to said first holding member, said connection portion threadably engaging an inner surface of said insertion well whereby said secondary ends of said collets are directed into said insertion well;

a collet channel extending into said second holding member, said collet well aligning with said collet channel when said second holding member is coupled to said first holding member, a foundation of said collet channel having an angled outside edge, said collet having a secondary end positioned in said collet channel whereby said secondary end abuts said foundation of said collet channel, said beveled outer edges of said primary end and said secondary ends of said collet being complimentary to said angled outside edges of said collet well and said collet channel whereby said secondary end of said collet is selectively positionable within said collet well and said primary end is selectively positionable within said collet channel;

a punch channel extending into said second holding member, said punch channel being aligned with said collet when said second holding member is coupled to said first holding member;

an alignment sleeve having an open end slidably insertable on said second holding member, said alignment sleeve having an alignment channel positionable to align with said punch channel when said alignment sleeve is coupled to said second holding member; and a punch being one of a plurality of punches each having an impact end selectively insertable into said punch channel, said impact end being insertable into said punch channel, said impact end being tapered extending towards said impact end of said punch, said plurality of punches having a striking end, each of said punches being configured to be struck on said striking end urging said impact end into an end of the hydraulic line whereby the end of the hydraulic line is flared by said impact end of said punch.

* * * * *